US005375529A

United States Patent [19]

Knight, Jr. et al.

[11] Patent Number: 5,375,529

[45] Date of Patent: Dec. 27, 1994

[54] PREFRAGMENTING MUNITIONS

[75] Inventors: C. Reed Knight, Jr.; Michael G. Adkins, both of Vero Beach, Fla.

[73] Assignee: SNC Industrial Technologies Inc./Les Technologies Industrielles SNC Inc., Montreal, Canada

[21] Appl. No.: 51,284

[22] Filed: Apr. 23, 1993

Related U.S. Application Data

[63] Continuation of Ser. No. 776,780, Oct. 18, 1991, abandoned.

[51] Int. Cl.[5] ..... F42B 8/14; F42B 10/32; F42B 12/40

[52] U.S. Cl. ..... 102/513; 102/502; 102/529

[58] Field of Search ..... 102/444, 502, 513, 515, 102/529

[56] References Cited

U.S. PATENT DOCUMENTS

| | | | |
|---|---|---|---|
| 3,170,405 | 2/1965 | Jungermann et al. | 102/529 |
| 3,338,167 | 8/1967 | Jungermann et al. | 102/529 |
| 3,433,157 | 3/1969 | Joch | 102/513 |
| 3,435,769 | 4/1969 | Germershausen | 102/529 |
| 3,916,795 | 11/1975 | Lemstra | 102/529 |
| 3,952,662 | 4/1976 | Greenlees | 102/502 |
| 3,983,817 | 10/1976 | Tucker | 102/444 |
| 4,030,421 | 6/1977 | Litman | 102/515 |
| 4,128,059 | 12/1978 | Black | 102/513 |
| 4,895,076 | 1/1990 | Looger et al. | 102/444 |
| 5,035,183 | 7/1991 | Luxton | 102/502 |

FOREIGN PATENT DOCUMENTS

| | | |
|---|---|---|
| 840898 | 10/1976 | Belgium . |
| 1550946 | 12/1968 | France . |
| 1578107 | 1/1971 | Germany . |
| 487389 | 4/1970 | Switzerland . |
| 1157555 | 7/1969 | United Kingdom . |

*Primary Examiner*—David H. Brown

[57] ABSTRACT

A projectile for firing from a self-loading firearm is provided that will permit the self-loading mechanism to function while delivering a targeting projectile of reduced range and striking capacity. These latter characteristics may be varied in accordance with a designer's preference.

13 Claims, 2 Drawing Sheets

PREFRAGMENTING MUNITIONS

This application is a continuation of application Ser. No. 07/776,780, filed Oct. 18, 1991, now abandoned.

FIELD OF THE INVENTION

This invention relates to ammunition for self-loading automatic or semi-automatic weapons. More particularly, it relates to ammunition that fires a projectile of reduced range and penetrating capacity, while providing sufficient recoil or gas pressure to cycle a weapon.

BACKGROUND TO THE INVENTION

Practice ammunition capable of cycling a recoil-operated firearm has been described, for example, in U.S. Pat. No. 3,785,293 to Barr et al. Such ammunition has a projectile with a frangible casing and finely-divided filling, which disintegrates and disperses its contents upon exiting the barrel. Due to the mass of the filling, the recoil and report of regular ammunition is provided, without the lethal risks of emitting a high velocity round.

For purposes of training, it is desirable to have a firearm emit a round that is capable of marking targets. For such purposes, at short ranges, it is not necessary for the projectile to have the mass of a regular bullet. In fact, for safety purposes, it is preferable that such a projectile have a low penetrating capacity, while at the same time remaining ballistically true at short ranges.

It would also be useful to provide a round of less than lethal character which nevertheless can be designed to achieve varying degrees of carriage and striking force, while still providing for the normal operation of self-loading weapons.

U.S. Pat. No. 3,433,157 to E. Joch, describes a practice projectile that combines a disintegrating casing, packed with a dispersible mass of particles, with a subcalibre marking projectile. The marking projectile is mounted within a centrally located tube within the principal projectile, such tube serving as a barrel for the marking projectile. This marking projectile is released from the main, outer projectile either during passage through the barrel or upon exiting from the muzzle of a firearm. The larger projectile, due to its frangible casing, breaks up in flight and disperses its heavy mass of contained particles within a relatively short range.

In the Joch invention special provisions control the advance of the marking projectile within its own barrel in synchronization with the advancement of the larger projectile down the barrel upon firing. The objects of these provisions are to ensure that the marking projectile is clear of the larger projectile when the larger projectile disintegrates, thus assuring that such disintegration does not interfere with the trajectory of the marking projectile.

Other references of possible, though less relevant, interest in this field include U.S. Pat. No.'s 2,835,198; 3,385,215; 3,898,933; 3,570,406; 4,942,818; 4,895,076; 4,716,835; 2,851,991; 3,090,309; 3,435,769; 2,439,619; and 3,463,047.

While the Joch patent describes a system for containing a marking round within a disintegrating projectile, it does not provide for a marking round which is full calibre in size. Further, the marking projectile cannot readily be variably controlled in respect of its effective range and striking power. The marking projectile in Joch is still of relatively lethal design and has a substantial, extended range capability. Lastly, the Joch concept is complicated by the presence of the small calibre barrel.

Accordingly, it is one of the objects of this invention to overcome these deficiencies and produce ammunition for self-loading weapons that have a ballistically reliable, target-marking capacity combined with a limited range and reduced penetrating capacity.

The invention in its general form will first be described, and then its implementation in terms of specific embodiments will be detailed with reference to the drawings following hereafter. These embodiments are intended to be exemplary, demonstrating the principle of the invention and the manner of its implementation. The invention in its broadest and more specific aspects will then be further described, and defined, in each of the individual claims which conclude this specification.

SUMMARY OF THE INVENTION

According to the invention in one of its broader aspects, a projectile for a self-loading firearm is provided which comprises:

(1) a frangible, outer projectile casing having a wall which fragments upon exiting the muzzle of a firearm;

(2) a dispersible mass contained as a filling within such projectile casing; and (3) a targeting projectile located rearward of the aforesaid dispersible mass.

wherein:

(1) by reason of its mass and aerodynamically inefficient configuration, the targeting projectile has a reduced range and penetration capacity in comparison with equivalent standard ammunition while maintaining the capacity to travel in a ballistically stable manner; and (2) the total mass of the projectile is sufficient to ensure the operation of the self-loading function of the firearm.

According to a further feature of the invention the targeting projectile may lie entirely rearwardly of the dispersible mass, and thereby provide support for such mass during firing.

By a further feature of the invention, the targeting projectile may be of full calibre or near full calibre in diameter and, if full calibre, may engage with the inner surface and rifling of a barrel upon firing. This latter feature is preferably achieved in conjunction with the use of a protruding rim as the engaging portion of the targeting projectile.

By a further feature of the invention, the disintegrating capacity of the casing may be enhanced by providing for its positive engagement with rifling within a barrel whereby, upon firing, the casing becomes scored and thereby disintegrates more readily under the centrifugal forces imparted by the rifling.

By a further feature of the invention the integrity of the projectile casing, prior to firing, may be improved by tightly packing the filling within the forward or nose end of the casing, to provide support for the casing nose and wall.

By a further optional feature of the invention the targeting projectile is generally in the form of a cylinder that is open at its forward end and is closed by a capping portion at its rearward or base end. The rearward end may be provided with a protruding rim that functions as an air-brake. The open, forward end may further be directly exposed to the dispersible mass which serves as a filling, and may carry a portion of such filling within its cylindrical walls after the projectile casing fragments.

By a further feature of the invention the accuracy of the targeting projectile is improved by having a ballistically stable mass and geometry, optimized by calibre for the different spins and velocities inherent in different calibres, e.g. 9 mm; 0.45 cal.; 5.56 mm.

The foregoing summarizes the principal features of the invention. The invention may be further understood by the description of the preferred embodiments, in conjunction with drawings, which now follow.

DESCRIPTION OF THE PREFERRED EMBODIMENT

Figure 1:
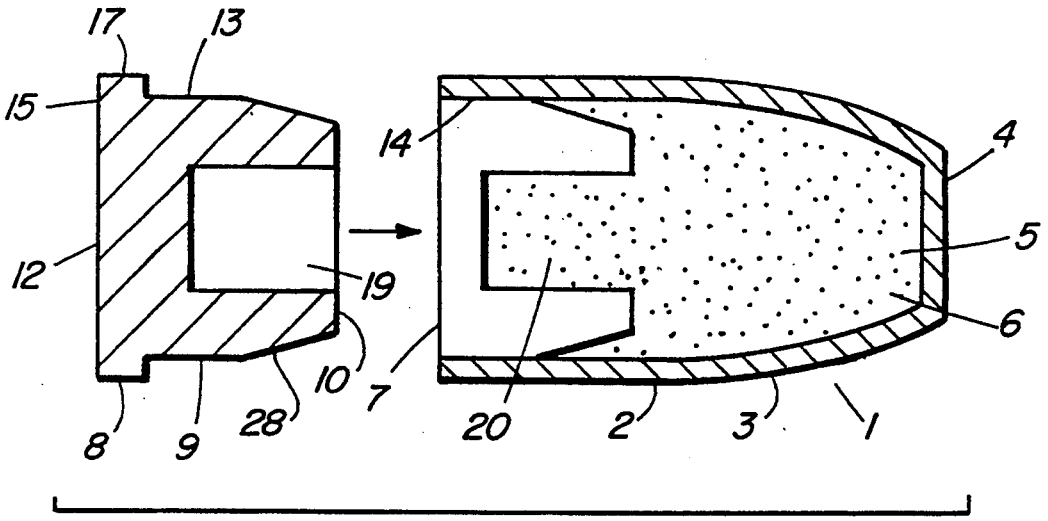
FIG. 1 is a cross-sectional view of a preferred version of the projectile made in accordance with the invention.

In FIG. 1 the preferred form of the projectile 1 is shown in an exploded cross-sectional view. A frangible outer projectile casing 2 is provided in the form of a thin-walled plastic shell. The walls 3 of the casing may be formed of a suitable polymeric plastic material, such as styrene, which has sufficient strength to retain its integrity while being fired down a barrel, but will fragment under the centrifugal forces of the spinning projectile upon exiting the muzzle of a firearm. The prior art patent U.S. Pat. No. 3,785,293 to Barr et al addresses these features.

Figure 4:
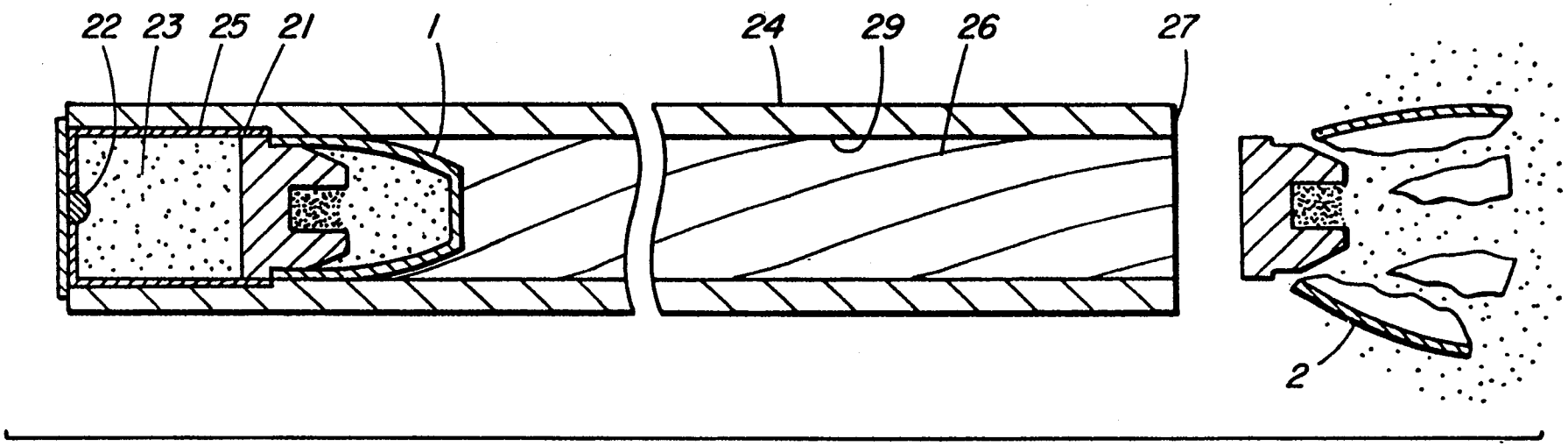
FIG. 4 is a cross-sectional view of the projectile of FIG. 1, shown within a gun barrel and after exiting the nuzzle.

FIG. 4 shows the preferred form of the projectile 1 mounted as part of a cartridge 21. This cartridge 21 has the customary primer 22 and sufficient propellant 23 to ensure that a self-loading firearm will cycle in the normal manner.

FIG. 4 also shows the presence of a rifle barrel 24 terminating at one end with a chamber 25 in which the cartridge 21 is mounted. At the other end, the barrel 24 is provided with a muzzle 27.

Within the barrel 24, the inner surface 28 of the barrel 24 is provided with rifling 26 in the customary manner. It is this rifling 26 which will induce the projectile 1 to spin and create a centrifugal force that will lead to fragmentation of the projectile casing 2 upon exiting the muzzle 27.

To enhance the tendency of the casing 2 to fragment, the nose-end 4 of the projectile 1 may be blunted, as shown in FIG. 1.

The casing 2 is packed within its interior 5 with a filling 6 that is finely divided in order to ensure its rapid dispersal upon fragmentation of the casing 2 and provide a dispersible mass. This filling 6 is preferably of high density in order to provide the projectile 1 with sufficient mass to allow a self-loading weapon, such as a 9 mm semi-automatic pistol, or submachine gun, 0.45 calibre machine gun or 5.56 mm automatic rifle to cycle in the normal manner. Apart from having a high density, the filling 6 should also have low toxicity.

A preferred filling 6 is powdered tungsten. One source for suitable tungsten is the series M, type 70 powdered tungsten produced by G.T.E. Sylvania Product Corporation. This powder, as measured on a Fisher Sub-Sieve Sizer (an ASTM standard) has a particle diameter of less than 15 micrometers, and an approximate bulk density of 6.1 grams/cubic centimeter.

In accordance with the loading process for a 9 mm round of normal proportions, approximately 80 grains of tungsten powder may be loaded into the casing 2 through its open, rearward end 7. This constitutes about two thirds of the volume of tungsten powder filling 6 and may be compacted, preferably under a pressure of 16 pounds per square inch, to provide support for the nose-end 4. The remaining one-third of the powder may then be poured loosely into the casing 2. This ratio should be adjusted to ensure a final, complete filling of the interior 5 with firmly held filling 6.

The projectile 8 is next inserted into the casing 2 through its rearward end 7. Sufficient filling 6 should be provided to ensure that the full interior volume 5 of the casing 2 is occupied by filling 6, once the targeting projectile 8 in position at the rearward end 7 of the casing 2.

The preferred form of the targeting projectile 8 incorporates a cylindrical portion 9, open at its forward end 10, and closed at its rearward end 11 by a capping portion 12 which serves as a base. The outer side 13 of the cylindrical portion 9 is of such a diameter as to provide an interference fit with the inside wall 14 of the casing 2. The cylindrical portion 9 is only generally cylindrical in shape and may depart from a perfect cylindrical shape, as by having a bevelled circumferential forward edge 28 to facilitate loading. This same bevelled edge 28 also improves the ballistic stability of the targeting projectile 8.

Surrounding the base end or capping portion 12 of this preferred embodiment of the targeting projectile 8 is a protruding, annular rim 15. This rim 15 may be of a width equivalent to the thickness of the wall 3 of the casing 2, or very slightly in excess to ensure that the outer edge 17 of this rim 15 engages with the rifling 26 within a barrel 24 of a firearm when the projectile 1 is fired.

The material for the targeting projectile 8, may be selected either from polymeric plastics or metals, based on the criteria that this substance must be tough enough to withstand the stresses of firing. A preferred material for a low-penetration targeting projectile 8 is nylon.

The use of a lighter material, such as nylon for the targeting projectile 1 will reduce the carrying and penetrating capacity for the targeting projectile 8. A denser material, such as copper, may be used when it is desired to increase these characteristics.

The cylindrical portion 9 of the targeting projectile 8 is preferably provided with an inner cavity 19 that may be of varying diameter. Since the targeting projectile 8 has an open forward end 10, the inner cavity 19 will fill with the filling 6 upon insertion of the targeting projectile 8 into the cap 2. This cavity portion 20 of the filling 6 will be carried with the targeting projectile 8 to the target.

By adjusting the diameter of the cavity 19, varying amounts of filling 6 can be carried by the targeting projectile 8. This feature allows the carrying and penetration capacity of the targeting projectile 8 to be further varied at will, with the object of providing the degree of carriage and penetration that the designer prefers.

The presence of the rim 15 at the rearward end 11 of the target projectile 8 also provides the designer with further flexibility in controlling these characteristics. The rim 15 provides an air brake effect that can be increased or decreased by varying the width of the rim 15.

While a preferred form of the projectile 1 incorporates a targeting projectile 8 as depicted in FIG. 1, the shape of the targeting projectile 8 is not necessarily so limited.

Figure 2:
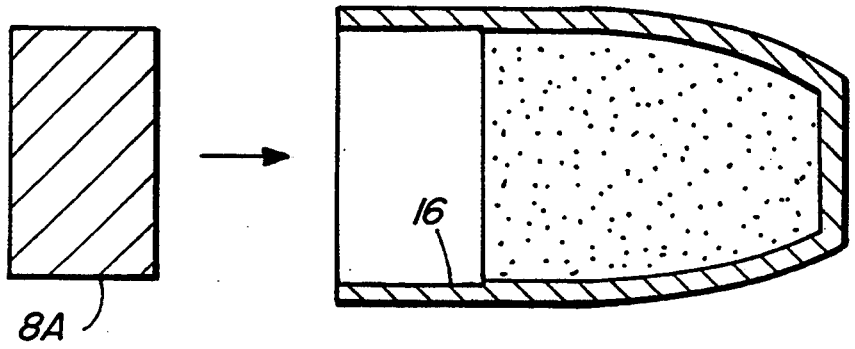
FIG. 2 is a cross-sectional view of an alternate version of the projectile.
Figure 3:
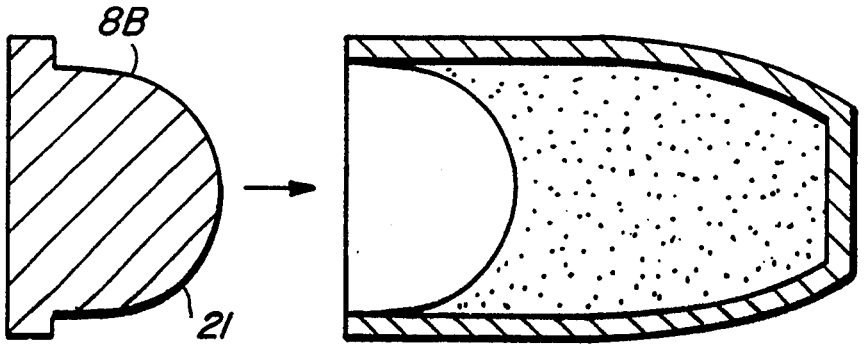
FIG. 3 is a cross-sectional view of an other alternate version of the projectile.

FIGS. 2 and 3 show alternately-shaped targeting projectiles 8*a*, 8*b* that will also function as part of the invention.

FIG. 2 shows a targeting projectile 8*a* in the form of a plain cylinder that is pressed into the rearward end of the casing 2 with an interference fit. A slight annular step 16 may be formed within the inner wall of the casing 2 to receive and locate this cylindrical targeting projectile 8*a*. While shown as a solid block this optional variant on the targeting projectile 8 may also be provided with a cavity (not shown) to receive filling 6.

In FIG. 3, the targeting projectile 8*b* has an ogive forward nose 21 to improve its aerodynamic efficiency. Thus the shape of the targeting projectile may be varied to render it more or less aerodynamically efficient, as for example by selecting from the various shapes of the three versions of the targeting projectiles 8, 8*a*, 8*b* as illustrated. Of course, those knowledgeable in this field will be able to select the specific shape which, combined with the other variables as described, will provide the carrying and penetration capacity of the design objective.

In all cases where the characteristics of the targeting projectile 8 are being selected, such projectile will be expected to operate in conjunction with the dispersible mass 6 located forward of the target projectile 8 in the frangible casing 2. It is the mass of this filling 6 which will ensure that the total mass of the projectile 1 is sufficient to enable a self-loading firearm to cycle in the normal manner.

Because the filling 6 will, by reason of its dispersible character, fall away upon fragmentation of the casing 2 after exiting the muzzle of a firearm, the carrying capacity and striking force of the targeting projectile 8 will be less than that of a prior-art, solid projectile, of the weight necessary to ensure proper cycling of a weapon.

CONCLUSION

The foregoing has constituted a description of specific embodiments showing how the invention may be applied and put into use. These embodiments are only exemplary. The invention in its broadest, and more specific aspects, is further described and defined in the claims which now follow.

The embodiments of the invention in which an exclusive property or privilege is claimed are defined as follows:

1. A projectile for a self-loading firearm said projectile comprising:

(1) a frangible, outer projectile casing having a wall which fragments upon exiting the muzzle of the barrel of a firearm;

(2) a dispersible mass contained as a filling within such projectile casing, said mass being finely divided so that it will self-disburse upon fragmentation of the projectile casing; and (3) a ballistically stable targeting projectile the entire part of which is located rearward of the aforesaid dispersible mass, the overall mass of said projectile being sufficient to ensure the operation of the self-loading function of said firearm.

2. A projectile as in claim 1 wherein a portion of said dispersible mass located within the forward, nose end of the casing is in a compacted state to provide support for the casing nose and wall.

3. A projectile as in claim 2 wherein said dispersible mass predominantly consists of finely divided tungsten.

4. A projectile as in claim 1 wherein the targeting projectile is of full-calibre, having a diameter sufficient to engage with rifling in the inner surface of the barrel of said weapon upon firing.

5. A projectile as in claim 4 wherein the outside diameter of the targeting projectile is defined by a protruding rim which serves as a barrel-engaging portion of such projectile.

6. A projectile as in claim 4 wherein the disintegrating capacity of the casing is enhanced by providing a full-calibre casing with a diameter which provides for positive engagement of the casing with the rifling within the barrel whereby, upon firing, the casing becomes scored and thereby disintegrates more readily under the centrifugal forces imparted by the rifling.

7. A projectile as in claim 1 wherein the targeting projectile is provided within a sidewall in the general form of a cylinder that is open at its forward end and is closed by a capping portion at its rearward end.

8. A projectile as in claim 7 wherein said rearward end is provided with a protruding rim that functions as an air-brake.

9. A projectile as in claim 7 wherein the forward end of the targeting projectile is directly exposed to the dispersible mass and a portion of such mass is contained within said sidewall to serve as a filling for the targeting projectile.

10. A projectile as in claim 9 wherein the targeting projectile is ballistically balanced to maintain said forward end oriented in the direction of travel of such targeting projectile and thereby contain and carry said portion of the dispersible mass within its cylindrical walls after the projectile casing fragments towards a target.

11. A projectile as in claim 1 wherein said dispersible mass predominantly consists of finely-divided tungsten.

12. A projectile as in claim 7 wherein said dispersible mass predominantly consists of finely divided tungsten.

13. A projectile as in claim 10 wherein said dispersible mass predominantly consists of finely divided tungsten.

* * * * *